United States Patent [19]

de Lyra

[11] 3,963,174

[45] June 15, 1976

[54] PERMANENT ENVELOPE

[76] Inventor: Rose T. de Lyra, 9280 Harding Ave., Surfside, Fla. 33154

[22] Filed: Oct. 10, 1974

[21] Appl. No.: 513,932

Related U.S. Application Data

[63] Continuation-in-part of Ser. No. 363,747, May 5, 1973, abandoned.

[52] U.S. Cl. ..... 229/80; 229/85

[51] Int. Cl.[2] ..... B65D 27/14; B65D 27/34

[58] Field of Search ..... 229/62, 85, 80, 71, 229/81

[56] References Cited

UNITED STATES PATENTS

| | | | |
|---|---|---|---|
| 958,543 | 5/1910 | Rippetoe | 229/80 |
| 1,964,596 | 6/1934 | Overly | 229/71 |
| 2,499,528 | 3/1950 | Reitzes | 229/85 |
| 3,047,206 | 7/1962 | Monahan et al. | 229/62 X |
| 3,128,936 | 4/1964 | Sprosty | 229/62 |
| 3,163,352 | 12/1964 | Fesco | 229/62 |
| 3,256,941 | 6/1966 | Rivman | 229/62 |

FOREIGN PATENTS OR APPLICATIONS

| | | | |
|---|---|---|---|
| 651,668 | 11/1962 | Canada | 229/62 |
| 317,932 | 1/1920 | Germany | 229/80 |

*Primary Examiner*—Stephen P. Garbe
*Attorney, Agent, or Firm*—Clarence A. O'Brien; Harvey B. Jacobson

[57] ABSTRACT

An enclosure including front and rear panels and having corresponding opposite side and opposite end edge portions is provided. Each pair of corresponding end edge portions and one pair of corresponding side edge portions of the front and rear panels are secured together with the other pair of corresponding side edge portions defining an opening therebetween. A closure gap including front and rear strips of a length greater than the aforementioned other pair of side edge portions of the front and rear panels is provided and the front and rear strips of the closure cap include corresponding opposite side and opposite end marginal portions with each pair of corresponding end marginal portions being secured together and one pair of corresponding side marginal portions being secured together, the other pair of corresponding side marginal portions of the cap defining an open side thereof. The aforementioned other pair of side marginal portions of the front and rear panels defining the opening of the enclosure have the open side of the cap telescoped thereover and the marginal portion of the enclosure defining the open side thereof over which the cap is telescoped includes an opening formed therethrough and the inner surfaces of those portions of the strips registered with the opening formed through the enclosure include adhesive structure for adhesively securing those portions together through the last mentioned opening. The cap portion of the envelope is designed to be discarded after each usage, but the envelope portion consisting of the front and rear panels aforementioned is constructed of a durable material and is designed to be repeatedly reused.

13 Claims, 4 Drawing Figures

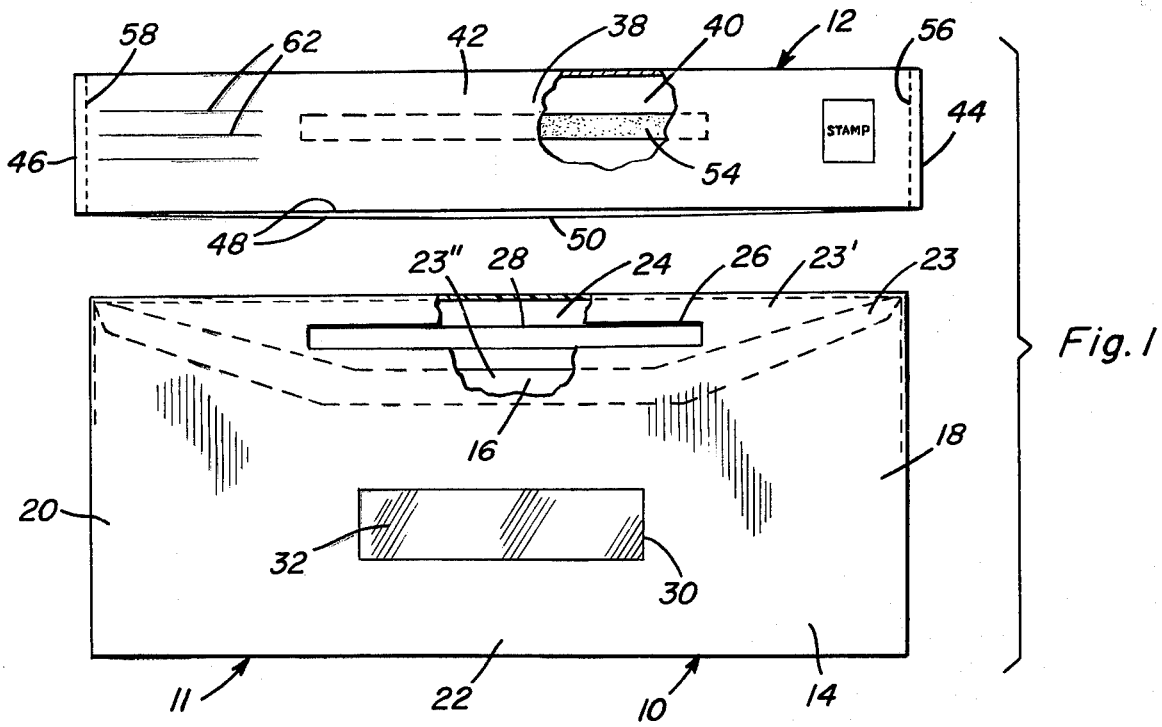
Fig. 1
Fig. 2
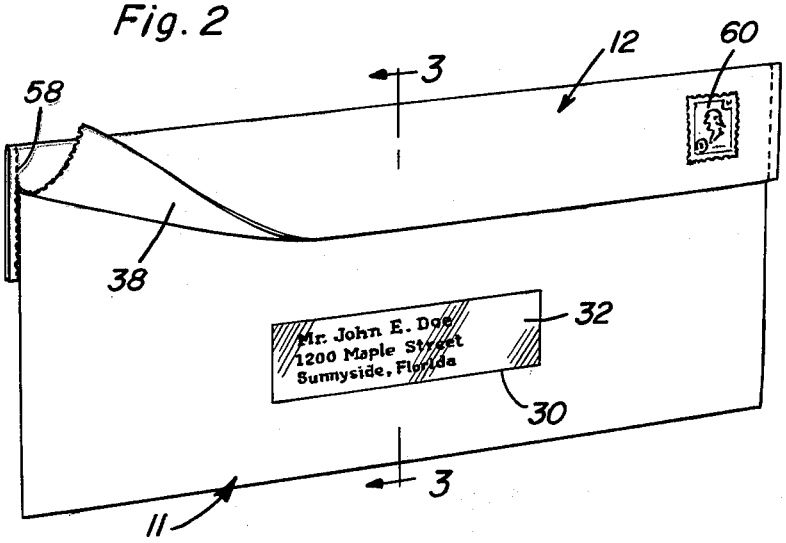
Fig. 3
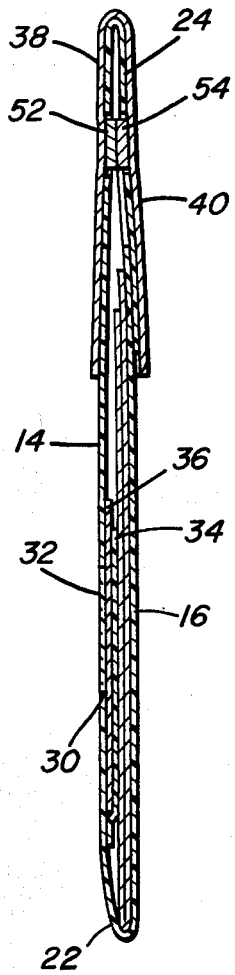
Fig. 4
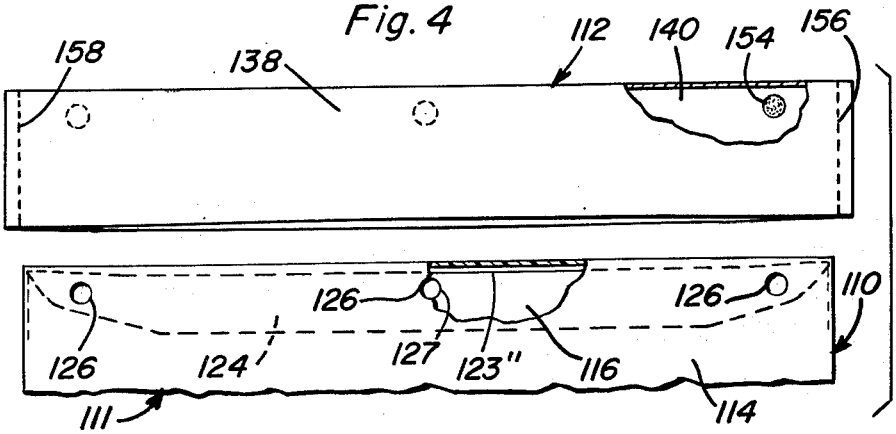

PERMANENT ENVELOPE

This application comprises a continuation-in-part of my U.S. application Ser. No. 363,747, filed May 5, 1973, and now abandoned.

BACKGROUND OF THE INVENTION

Various forms of reusable envelopes have been heretofore provided, but most of these reusable envelopes include closure portions thereof which are formed integrally with the remainder of the envelope and may only be reused a limited number of times. Accordingly, most previously designed reusable envelopes have a limited capability of being reused.

Examples of previously patented reusable envelopes are disclosed in U.S. Pat. Nos. 2,194,400, 2,400,406, 2,794,590 and 3,702,171.

SUMMARY OF THE INVENTION

The permanent envelope of the instant invention utilizes a basic envelope portion devoid of the usual flap structure and which may be reused any number of times. The envelope does, however, include a discardable cap portion for closing the open side of the reusable envelope. The cap portion or structure is adhesively secured, by means of its own adhesive, over the open side of the envelope portion through at least one opening formed through the envelope portion and the cap portion or structure may be constructed of paper or other materials to be discarded after once being used.

The main object of this invention is to provide an envelope constructed in a manner such that a major portion thereof consisting of the main body of the envelope may be reused any number of times.

Another object of this invention is to provide a reusable main body portion of an envelope having one open side and a cap constructed of paper or other suitable readily disposable material for closing the open side of the reusable main envelope portion.

Yet another object of this invention is to provide a cap structure in accordance with the preceding object including adhesive structure whereby the cap portion may be adhesively secured over the open side of the envelope portion.

A final object of this invention to be specifically enumerated herein is to provide a reusable envelope in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is an exploded elevational view of the envelope and cap portions of the invention with portions of the envelope portion and cap portion being broken away and illustrated in section;

FIG. 2 is a perspective view of the envelope with the envelope and cap portions being in assembled condition and with one end portion of the cap in the process of being removed from the envelope;

FIG. 3 is an enlarged sectional view taken substantially upon the plane indicated by the section line 3—3 of FIG. 2; and FIG. 4 is an elevational view of the upper portion of a modified form of envelope and an associated modified form of cap.

DETAILED DESCRIPTION OF THE INVENTION

With attention now invited more specifically to FIGS. 1 through 3 of the drawings, the numeral 10 generally designates the reusable envelope assembly of the instant invention. The envelope assembly 10 includes an envelope portion referred to in general by the reference numeral 11 and a cap portion referred to in general by the reference numeral 12.

The envelope portion 11 includes front and rear panels 14 and 16 disposed in superposed relation and the panels 14 and 16 include corresponding opposite end edge portions 18 and 20 and corresponding opposite side edge portions 22 and 23. Corresponding edge portions 18 and 20 are secured together as are corresponding edge portions 22. However, the corresponding edge portions 23 are not secured together and include a generally straight edge portion 23' on the front panel 14 and a relieved edge portion 23'' on the rear panel 16. The edge portion 23' includes an integral flap portion 24 which is folded down over the outer surface of the edge portion 23'' and the edge portion 23' and flap 24 include registered longitudinally extending openings 26 and 28.

The front panel 14 includes a window 30 which may be equipped with a transparent cover panel 32 secured over the inner surfaces of the front panel 14 extending about the window 30 and the inner side of the panel 14 further includes pocket-defining structure 32 adhered thereto for receiving and supporting a card 36 of the like and positioning the same in registry with window 30.

The cap portion 12 includes front and rear strips 38 and 40 joined along one set of corresponding longitudinal side marginal portions 42 and corresponding end marginal portions 44 and 46 with the other pair of corresponding longitudinal marginal portions 48 of the front and rear strips 38 and 40 free of attachment to each other and defining an open side 50 of the cap portion 12. The strips 38 and 40 are slightly longer than the corresponding marginal portions 23 of the envelope portion 11 and the cap portion 12 is therefore telescopingly engageable over the corresponding side edge portions 23 as well as the flap 24. The inner surfaces of the strips 38 and 40 registered with the slots 26 and 28 include adhesive strips 52 and 54 adhesively engaged with each other through the slots 26 and 28 to thereby adhesively secure the cap portion 12 over the corresponding longitudinal edge portions 23 of the envelope portion 11.

Corresponding opposite ends of the strips 38 and 40 are equipped with transversely spaced perforated zones 56 and 58 whereby the end portions of the strip 40 may be readily separated from the corresponding end portions of the strip 42. Similarly, if the assembly 10 is to be opened from the rear side thereof, the ends of the strips 40 may be separated from the corresponding ends of the strip 42.

It will be noted from FIGS. 1 and 2 of the drawings that the right-hand end of the strip 38 may be utilized to receive a postage stamp 60 and that the left-hand end of the strip 38 is provided with lines 62 upon which a return address may be placed. Further, the card 36 will have the address of the person to whom the assembly is being mailed noted thereon. Of course, if it is not desirable to use a card 36, the material enclosed within the assembly 10 for mailing may include the address of the person to whom the assembly is being mailed and positioned thereon so as to be viewable through the window 30. Also, the flap 24 may be dispensed with if the longitudinal edge portion 23'' is constructed so as to be equivalent to the longitudinal edge portion 23' and the equivalent of the opening 28 formed in the flap 24 is then formed in the modified longitudinal edge portion of the rear panel 16 corresponding to the edge portion 23' of the front panel 14.

With attention now invited more specifically to FIG. 4 of the drawings there will be seen a modified form of assembly referred to in general by the reference numeral 110 and which includes a modified edge portion 123'' of the back panel 116 corresponding to the panel 16. The front panel 114 corresponding to the panel 14 includes longitudinally spaced apertures 126 serving as the equivalent of the slot 26, the modified marginal edge portion 116 includes corresponding longitudinally spaced apertures 127 and the flap 124 corresponding to the flap 24 is equipped with further longitudinally spaced apertures (not shown) registered with the apertures 126 and 127. In addition, the assembly 110 includes a cap portion 112 corresponding to the cap portion 12 and which is equipped with longitudinally spaced adhesive discs 154 on the inner surfaces of both strips 138 and 140 corresponding to the strips 38 and 40 and which are adhesively engageable with each other through the registered apertures 126 and 127 as well as the apertures formed in the flap 124. Further, the opposite ends of the strips 138 and 140 are provided with weakened perforated zones 156 and 158 corresponding to the perforated zones 56 and 58. Accordingly, it may be seen that the operation of the assembly 110 is substantially identical to the operation of the assembly 10. Further, the flap 124 of the envelope portion 111 may be readily dispensed with without further modification of the envelope portion 111.

It is pointed out that the envelope portions 11 and 111 will be constructed of a durable material of any suitable type in order that the envelope portions 11 and 111 may be repeatedly used. However, the cap portions 12 and 112 are designed to be used only once and may be discarded after each usage. Therefore, the cap portions 12 and 112 may be constructed of an inexpensive material and if the cap portions 12 and 112 are constructed of paper, by constructing the envelope portions 11 and 111 out of some other suitable and more durable material considerable savings in the use of wood in producing envelopes will be realized.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A permanent type envelope including front and rear panels and having corresponding opposite side and opposite end edge portions, first means securing said panels together along corresponding end edge portions and one pair of corresponding side edge portions of said panels with the other corresponding side edge portions of said panels defining an opening therebetween and an open side of said envelope, a closure cap including front and rear strips of a length greater than said other pair of edge portions and having corresponding opposite side and opposite end marginal portions, second means securing said strips together along corresponding end marginal portions thereof and along one pair of corresponding side marginal portions with the other side marginal portions of said strips defining an open side of said cap, said envelope defining at least one through opening formed therein adjacent said open side thereof and spaced from the opposite ends of the open envelope side, the open side of said cap being telescoped over the open side of said envelope with predetermined portions of the inner surfaces of said strips registered with said through opening, at least one of said predetermined portions including means displaceable through said through opening for securing said predetermined portions together through said through opening and thereby securing said cap over the open side of said envelope independent of other attachment of said cap to said envelope, said second means including corresponding end edge portions of said strips joined together and to the adjacent portions of said strips along transversely extending weakened zones thereof for removal of said corresponding end edge portions along said weakened zones, the spacing between opposite end weakened zones of said strip being slightly greater than the distance between the remote end edge portions of said front and rear panels.

2. The combination of claim 1 wherein said coacting means includes adhesive means on each of said predetermined portions.

3. The combination of claim 2 wherein said adhesive means comprises contact adhesive.

4. The combination of claim 1 wherein one of said panels includes a marginal flap extending along and folded over said open side of said envelope and the corresponding edge of the other panel, said opening including registered openings formed through said one panel and said flap.

5. The combination of claim 4 wherein said registered openings are elongated and extend along the open side of said envelope.

6. The combination of claim 1 wherein said registered openings include a plurality of registered openings spaced apart along said open side of said envelope.

7. The combination of claim 1 wherein said weakened zones comprise transverse perforated zones of said end edge portions of said strips.

8. The combination of claim 7 wherein said coacting means includes adhesive means on each of said predetermined portions.

9. The combination of claim 8 wherein said one of said panels includes a marginal flap extending along and folded over said open side of said envelope and the corresponding edge of the other panel, said opening including registered openings formed through said one panel and said flap, said registered openings including elongated openings extending along said other side edge portion.

10. The combination of claim 8 wherein said registered openings include a plurality of registered openings spaced apart along said other side edge portion.

11. The combination of claim 1 wherein said front panel includes a window therein for viewing the address to which the envelope is to be mailed.

12. The combination of claim 11 wherein the inner surface of the front panel of the envelope includes means for supporting a panel like structure having the addressee's name and address thereon within the envelope in registry with said window for viewing through the latter.

13. The combination of claim 1 wherein opposite ends of the outer surface of the front strip define areas of sufficient width to receive the return address to be placed on the envelope and the necessary postage to mail the envelope.

* * * * *